US007044861B1

(12) United States Patent
Nally et al.

(10) Patent No.: US 7,044,861 B1
(45) Date of Patent: May 16, 2006

(54) REINFORCED CUE STICK

(75) Inventors: Michael Nally, Ridgewood, NJ (US); Mark Zehfuss, Morristown, NJ (US); David Rossi, Newton, NJ (US)

(73) Assignee: Sportcraft, Ltd., Mt. Olive, NJ (US)

( * ) Notice: Subject to any disclaimer, the term of this patent is extended or adjusted under 35 U.S.C. 154(b) by 0 days.

(21) Appl. No.: 10/681,048

(22) Filed: Oct. 8, 2003

(51) Int. Cl.
*A63D 15/08* (2006.01)

(52) U.S. Cl. ..... 473/44

(58) Field of Classification Search ..... 473/44–51; 428/36.2

See application file for complete search history.

(56) References Cited

U.S. PATENT DOCUMENTS

| | | | | | |
|---|---|---|---|---|---|
| 3,462,147 | A * | 8/1969 | Mancuso | 473/44 |
| 4,688,796 | A | 8/1987 | Wright | 273/68 |
| 4,816,203 | A * | 3/1989 | Son-Kung | 264/516 |
| 4,943,333 | A * | 7/1990 | Chang | 156/153 |
| 5,558,584 | A | 9/1996 | Brown | 473/44 |
| 5,997,970 | A * | 12/1999 | You | 428/36.2 |
| 6,155,929 | A | 12/2000 | Chipman | 473/2 |
| 2002/0072424 | A1* | 6/2002 | Yu | 473/44 |
| 2002/0082098 | A1* | 6/2002 | La Chuang | 473/44 |
| 2003/0036434 | A1* | 2/2003 | Wu | 473/44 |
| 2003/0224865 | A1* | 12/2003 | Lai | 473/44 |

FOREIGN PATENT DOCUMENTS

| | | | |
|---|---|---|---|
| GB | 2060411 A | * | 5/1981 |
| GB | 2209681 A | * | 5/1989 |
| GB | 2 276 825 A | | 10/1994 |

* cited by examiner

*Primary Examiner*—Mark S. Graham
(74) *Attorney, Agent, or Firm*—Fellers, Snider, Blankenship, Bailey & Tippens, P.C.

(57) ABSTRACT

A cue stick of the type used for playing billiards. A deflection resistant strengthening wrap is located adjacent a terminal end of the cue stick, and/or at other points on the cue stick that may experience deflection during a ball strike. A first strengthening wrap substantially prevents deflection of the tip piece upon impact with a billiard ball. Other strengthening wraps may be provided to prevent deflection at other locations on the cue stick. The strengthening wraps are composites formed of a screen, a sheet of material, and a resin. The screen is preferably metallic. The sheet of material is a plurality of fibers that form a fiber wrap of graphite, fiberglass, kevlar, or other material.

5 Claims, 2 Drawing Sheets

REINFORCED CUE STICK

BACKGROUND OF THE INVENTION

Billiard games are played on a pool or billiards table and involve striking a round ball with a cue stick. The term "billiards" encompasses a number of games played with a tapered stick called a cue and various numbers of balls on a rectangular, cloth covered slate table with raised and cushioned edges. An American form of billiards, typically referred to as "pool" is played on a table usually 1.4×2.7 m (4.5×9 ft) having six pockets. The object of pool is to use a white cue ball to put 15 colored balls into pockets, which are spaced around the edge of the table. In billiard games, a player most skilled in controlling the direction, speed and spin imparted to a ball upon being struck by the cue stick has a considerable advantage over a player of lesser skill.

A typical cue stick has a length of fifty-seven inches and is circular in cross section. A cue stick is provided with a terminal end, which is used to impact a ball. Approximately the half of the stick nearest the terminal end may be referred to as the slide portion. The portion of the stick from about the midway point in the opposite direction may be referred to as the grip portion. The grip portion typically has a relatively constant circular cross-section and provides a gripping surface.

In use, a player typically employs both hands when attempting to strike a ball. A guide hand is placed near a ball to be hit and forms a guide for the stick. The tapered slide portion of the cue stick is typically supported between the thumb and index finger of the guide hand. A grip hand is used to grasp the grip portion on the cue stick. The grip hand is used to aim the cue stick and to impart forward movement to the cue stick for impacting the ball.

Throughout a game certain shots require that a ball, such as the white cue ball used in pool, be struck with great force. This is particularly true of the first shot in pool, commonly known as the opening break shot or "break". Highly skilled players are able to precisely control the direction, speed and spin imparted to the ball during a shot. Consequently, it is desirable that no deflection is experienced by the pool cue that may adversely affect the direction or spin or the ball, i.e., that may negatively impact the ability of a player to precisely control the ball with a shot.

SUMMARY OF THE INVENTION

The invention relates to a cue stick of the type used for playing billiards. The cue stick has a small diameter terminal end that defines a recessed area. The terminal end of a cue stick is the area most susceptible to damage during play. A strengthening wrap is located in the recessed area. A tip piece communicates with the strengthening wrap. The increased stiffness resulting from the strengthening wrap reduces tip deflection and allows for enhanced ball control, and, therefore, greater accuracy.

The strengthening wrap substantially prevents deflection of the tip piece upon impact with a billiard ball. The strengthening wrap is a composite formed of a screen, a layer of material, and a resin. The screen is preferably titanium, copper, or other metal. The layer of material may be a fiber wrap such as graphite, fiberglass, Kevlar, or other material. The tip piece preferably includes a metallic section and a cue tip. In a preferred embodiment, the cue stick includes a grip portion having rigid sleeve on a second end and a slide portion having a rigid sleeve on a first end. When the grip portion and the slide portion are joined together, the rigid sleeve of the grip portion and the rigid sleeve of the slide portion mate against one another for forming a deflection resistant interface. To further stiffen the cue and prevent deflection, additional strengthening wraps may be provided adjacent the rigid sleeve on the grip portion and adjacent the rigid sleeve on the slide portion.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE INVENTION

Referring now to FIGS. 1–4, shown is a cue stick designated generally 10. Cue stick 10 has a grip portion 12 and a slide portion 14.

Figure 1:
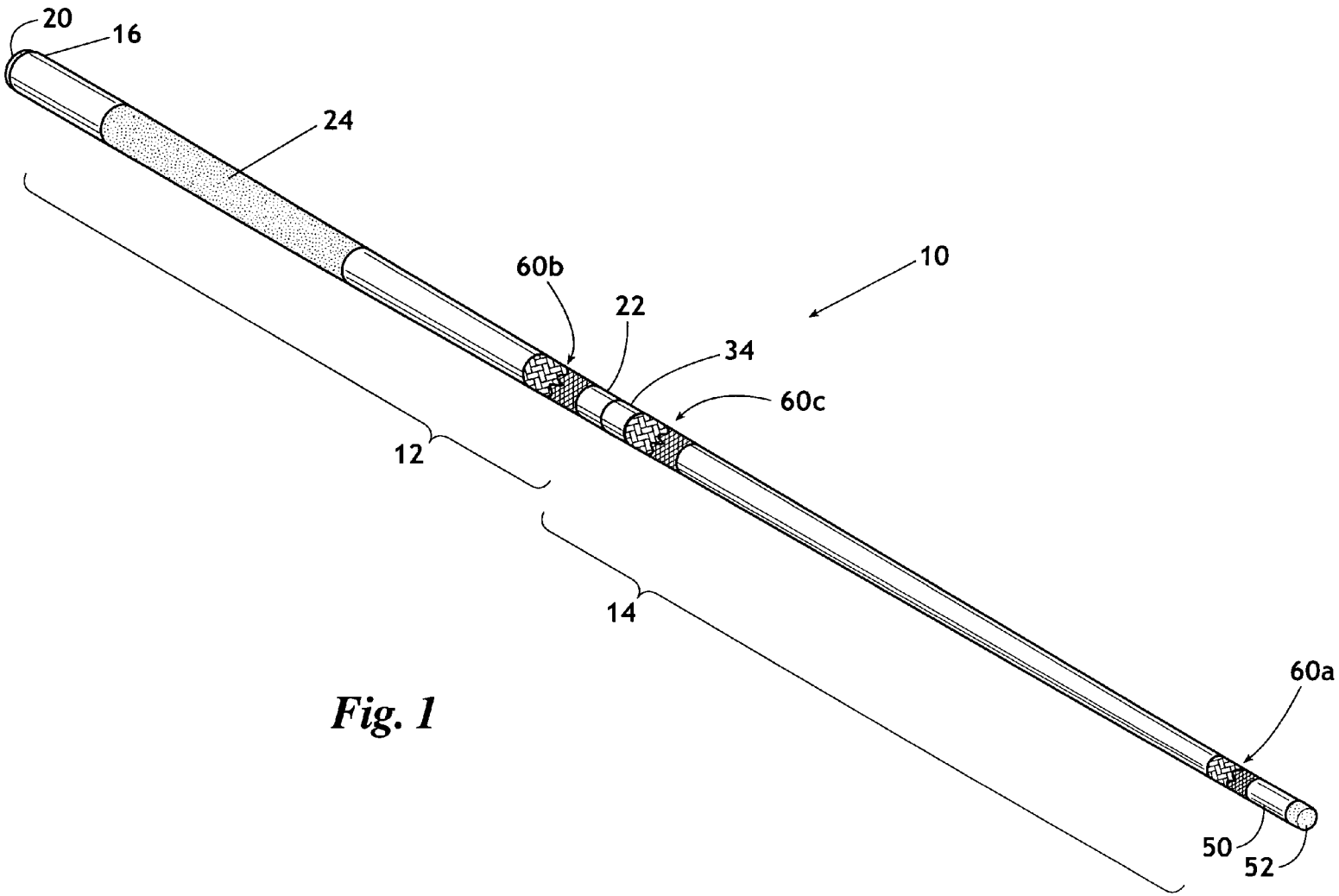
FIG. 1 is a perspective view of the cue stick of the invention.
Figure 2:
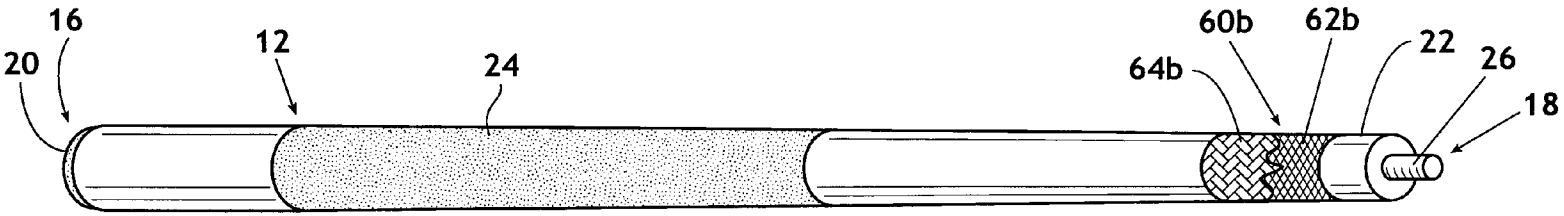
FIG. 2 is a perspective view showing the grip portion of the cue stick of FIG. 1 in a disassembled condition.

Grip portion 12 (FIGS. 1, 2) has a first end 16 and a second end 18 (FIG. 2). Grip portion 12 preferably has an elastomeric bumper 20 located on first end 16. Additionally, grip portion 12 preferably has a rigid sleeve 22 located on second end 18. Grip portion 12 may be provided with a gripping material 24 to provide a no slip surface for grasping the cue stick 10 during play. A threaded protrusion 26 (FIG. 2) preferably extends from the second end 18 of grip portion 12.

Slide portion 14 (FIGS. 1, 3) has a first end 30 (FIG. 3) and a striking end 32. Slide portion 14 preferably has a rigid sleeve 34 provided on first end 30. Striking end 32 (shown in an exploded view in FIG. 4) is preferably provided with a recessed area 36 that mates, adhesively or otherwise, with an end surface 38 of tip piece 50. A threaded receptacle 40 (FIG. 3) is preferably provided in the first end 30 of the slide portion 14. Threaded receptacle 40 is provided for receiving the threaded protrusion 26 (FIG. 2) for securing the grip portion 12 to the slide portion 14 to form an assembled cue stick 10 (FIG. 1) for play.

Rigid sleeve 22 (FIGS. 1, 2) on a second end 18 of grip portion 12 and rigid sleeve 34 (FIGS. 1, 3) on a first end 30 of slide portion 14 mate against one another when cue stick 10 is assembled. Sleeves 22 and 34 form a deflection resistant interface when abutted against one another. Sleeves 22 and 34 may be formed of titanium, copper or other sufficiently rigid metal or non-metal surface.

Tip piece 50 (FIGS. 1, 3, 4) is affixed to an end surface of the striking end 32 of slide portion 14. In a preferred embodiment, tip piece 50 is affixed to the end surface 38 with an adhesive. However, other methods of affixing the tip piece 50 to the end surface 38 are contemplated to be within the scope of the invention. Tip piece 50 is preferably made of metal. Tip piece 50 and cue stick tip 52 form a tip assembly. Cue stick tip 52 is provided with a threaded extension 54 for engaging a threaded receptacle formed in tip piece 50. Cue stick tip 52 is provided for impacting a cue ball.

A strengthening wrap 60*a* is preferably located within the recessed area 36, which is located on striking end 32 of slide portion 14. Preferably, the strengthening wrap 60*a* has a thickness such that when the strengthening wrap 60*a* (FIGS.

1, 3) is located within the recessed area 36 (FIG. 4) an outer diameter of the strength wrap 60*a* is equal to the outer diameter of adjacent areas of the sliding portion 14 and tip piece 50 when assembled. In other words, a transition from the slide portion 14 to the strengthening wrap 60*a* and to the threaded tip piece 50 is preferably undetectable by feeling the outside surface of the cue stick 10. To provide support, an end surface of strengthening wrap 60*a* contacts an outer portion of end surface 38 of tip piece 50.

Additionally, recessed areas (not shown) may be located adjacent rigid sleeve 22 and rigid sleeve 34. Additional strengthening wraps 60*b* and 60*c* (FIGS. 1–3) may be located in the recessed areas. Strengthening wrap 60*b* preferably has a thickness such that when strengthening wrap 60*b* is located within its recessed area, an outer diameter of strengthening wrap 60*b* is equal to the outer diameter of adjacent areas of the grip portion 12 and sleeve 22. Additionally, strengthening wrap 60*c* preferably has a thickness such that when strengthening wrap 60*c* is located within its recessed area, an outer diameter of strengthening wrap 60*c* is equal to the outer diameter of adjacent areas of slide portion 14 and sleeve 34. To provide support, an end surface of strengthening wrap 60*b* contacts an outer portion of sleeve 22 and an end portion of strengthening wrap 60*c* contacts an outer portion of sleeve 34.

Figure 3:
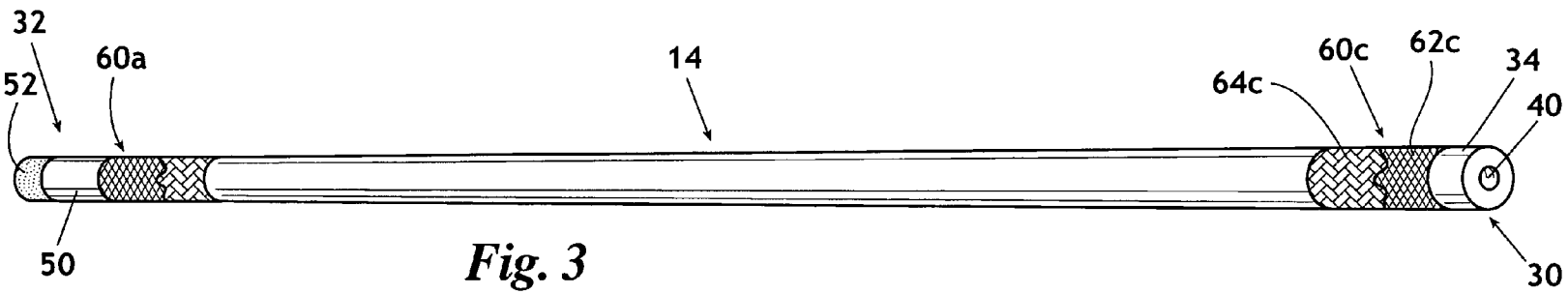
FIG. 3 is a perspective view showing the slide portion of the cue stick of FIG. 1 in a disassembled condition.
Figure 4:
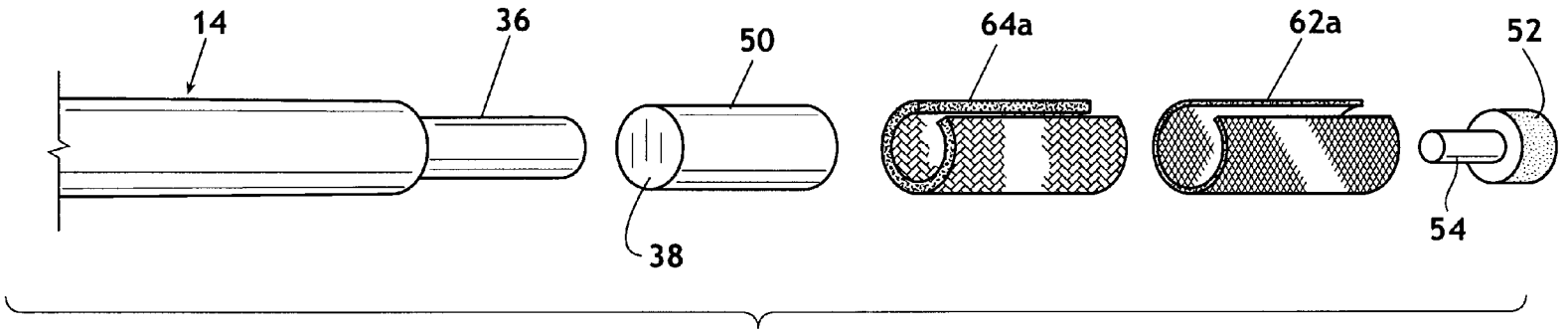
FIG. 4 is an exploded view of a striking end of the cue stick of FIG. 1.

Referring to FIGS. 2, 3 and 4, strengthening wraps 60*a*–*c* include metallic screens 62*a*–*c*, respectively. Metallic screens 62*a*–*c* may be constructed of copper mesh, titanium mesh or of another material. Strengthening wraps 60*a*–*c* additionally include a sheet of material 64*a*–*c*, respectively. The sheets of material 64*a*–*c* may be graphite, Kevlar, fiberglass or other material. As set forth above, the strengthening wraps 60*a*–*c* are located in recessed areas. Strengthening wrap 60*a* is shown in recessed area 36 (FIG. 4). Sheets of material 64*a*–*c* are located within the recessed areas of the cue stick 10, and metallic screens 62*a*–*c* are also located in the recessed areas. An epoxy or resin is delivered onto the metallic screens 62*a*–*c* and sheets of material 64*a*–*c* to form assemblies that fuse screens 62*a*–*c* and sheets of material 64*a*–*c* into strengthening wraps 60*a*–*c*. The end result is that the metallic screens 62*a*–*c* and sheets of material 64*a*–*c* form composites that function as strengthening wraps 60*a*–*c*. Preferably, metallic screens 62*a*–*c* are formed from the same material as sleeves 22 and 34 to produce a coordinated appearance. Metallic screens 62*a*–*c* and sheets of material 64*a*–*c* are shown separately in FIGS. 1 through 3. However, it should be understood that in the preferred embodiment metallic screens 62*a*–*c* overlay respective sheets of material 64*a*–*c* or vice versa. Strengthening wrap 60*a* is shown in a disassembled state in FIG. 4 to show metallic screen 62*a* and sheet of material 64*a*. In a preferred embodiment, strengthening wraps 60*b* and 60*c* are constructed in a similar manner.

During a pool or billiards match, when a player strikes a ball with cue stick tip 52, impact forces are transmitted along the cue stick 10. In particular, tip piece 50 delivers impact forces to an end surface of slide portion 14. To substantially prevent deflection of tip piece 50 under impact loading, strengthening wrap 60*a* provides a deformation resistant support to a perimeter of end surface 38 of tip piece 50. To further eliminate deflection of the cue stick due to impact forces, strengthening wraps 60*b* and 60*c* provide deformation resistant support to a perimeter of sleeves 22 and 34, respectively. More particularly, the metallic screen and fiber composite of strengthening wraps 60*a*–*c* provide deflection eliminating strength not found in cue sticks having a more conventional construction.

Consequently, one advantage of the cue stick 10 of the invention is the novel deflection resistant construction described above. Therefore, the cue stick 10 of the invention eliminates shot inaccuracies due to structural weaknesses that are inherent in conventional cue stick designs.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. A cue stick comprising:

a grip portion;

a slide portion adjacent said grip portion;

a tip on a terminal end of said slide portion;

a recessed area defined by one of said grip portion and said slide portion at a location selected from a group consisting of approximately adjacent an interface between said grip portion and said slide portion and approximately adjacent said tip;

a strengthening wrap received in said recessed area; and wherein said strengthening wrap is a composite comprising a metallic screen, a sheet of non-metallic material adjacent said metallic screen, and a resin for bonding said sheet of non-metallic material and said metallic screen;

wherein said screen is comprised of copper.

2. A cue stick comprising:

a grip portion;

a slide portion adjacent said grip portion;

a tip on a terminal end of said slide portion; and a strengthening wrap adjacent said tip and in communication with said tip for substantially preventing deflection of said tip upon impact with a billiard ball; and wherein said strengthening wrap is a composite comprising a copper screen, a sheet of material adjacent said copper screen, a resin for bonding said sheet of material and said copper screen.

3. The cue stick according to claim 2 further comprising:

a strengthening wrap approximately adjacent an interface between said grip portion and said slide portion.

4. A cue stick comprising:

a grip portion having rigid sleeve on a second end;

a slide portion having a terminal end defining a recessed area and having a rigid sleeve on a first end; and wherein when said grip portion and said slide portion are joined together, said rigid sleeve of said grip portion and said rigid sleeve of said slide portion mate against one another for forming a deflection resistant interface;

a strengthening wrap in said recessed area; and a tip in communication with said strengthening wrap, said strengthening wrap for substantially preventing deflection of said tip upon impact with a billiard ball;

wherein said strengthening wrap is a composite comprising a copper screen, a sheet of material adjacent said screen, and a resin for bonding said sheet of material and said screen.

5. The cue stick according to claim 4 further comprising:

a strengthening wrap adjacent a location selected from a group consisting of approximately adjacent an interface between said grip portion and said slide portion.

* * * * *